US006612007B1

(12) United States Patent
Wade

(10) Patent No.: US 6,612,007 B1
(45) Date of Patent: Sep. 2, 2003

(54) DUCTILE MATERIAL CLINCH JOINER

(76) Inventor: Colin Maxwell Wade, 12 Boundary Road, Red Lodge, Bury St. Edmunds, Suffolk TP28 8JO (GB)

( * ) Notice: Subject to any disclaimer, the term of this patent is extended or adjusted under 35 U.S.C. 154(b) by 0 days.

(21) Appl. No.: 09/571,800

(22) Filed: May 16, 2000

(51) Int. Cl.[7] ..... B23P 11/00
(52) U.S. Cl. ..... 29/243.5; 29/283.5
(58) Field of Search ..... 29/21.1, 243.5, 29/521, 522.1, 798, 283.5

(56) References Cited

U.S. PATENT DOCUMENTS

| | | | | |
|---|---|---|---|---|
| 4,459,735 A | | 7/1984 | Sawdon | |
| 4,757,609 A | | 7/1988 | Sawdon | |
| 4,910,853 A | | 3/1990 | Sawdon | |
| 5,027,503 A | | 7/1991 | Sawdon | |
| 5,150,513 A | | 9/1992 | Sawdon | |
| 5,177,861 A | | 1/1993 | Sawdon | |
| 5,208,973 A | | 5/1993 | Sawdon | |
| 5,267,383 A | * | 12/1993 | Sawdon | 29/243.5 |
| 5,479,687 A | * | 1/1996 | Sawdon | 29/243.5 |
| 5,581,860 A | | 12/1996 | Sawdon | |
| 5,782,130 A | | 7/1998 | Sawdon | |
| 5,860,315 A | | 1/1999 | Sawdon | |

FOREIGN PATENT DOCUMENTS

| | | |
|---|---|---|
| EP | 0 398 959 B1 | 8/1993 |
| GB | 2 069 394 A | 2/1981 |
| WO | WO 94/22613 | 10/1994 |

* cited by examiner

*Primary Examiner*—Robert C. Watson
(74) *Attorney, Agent, or Firm*—Kirton & McConkie; Michael F. Krieger

(57) ABSTRACT

The present invention relates to a clinch joiner (1) for clinch joining ductile layers of material (7,8), such as metal sheets, and in particular to and a joiner including a die (4) and a punch (2). The die comprises: a die anvil (44) with a body portion (48) and an anvil surface (46); at least two die blades (56) that extend transverse to the anvil surface (46) to form a die aperture (57), the separation between the blades (56) defining a die aperture width and the extension of the die blades above the anvil surface (46) defining a die aperture depth; at least one pivot recess (68) in the body portion (48); a protrusion (58) on each of the die blades (56) that is seated in a matching pivot recess (68) to form a pivot joint by which each die blade (56) may pivot to constrict and dilate the die aperture (57); at least one biasing member (70) by which the die blades (56) are biased to constrict the die aperture (57); and a die shield (14) that limits the extent by which the die blades (56) may pivot to dilate the die aperture (57). The pivot joints (58,68) extend underneath the anvil surface (46) so that when the die aperture (57) is dilated the depth of the die aperture is decreased.

15 Claims, 5 Drawing Sheets

5
1
18
2
32
30
16
28
27
22
26
25
20
10
10
34
12
24
36
37
7
44
57
56
56
8
9
14
58
58
70
68
68
48
4
6

DUCTILE MATERIAL CLINCH JOINER

BACKGROUND a. Field of the Invention

The present invention relates to a joiner for clinch joining ductile materials, such as metal sheets, and in particular to a joiner including a die and a punch assembly.

b. Related Art

It is known to join a plurality of sheets of ductile material by causing these to be deformed into an interlocking configuration in a local area. Such joins are made by ductile material joining tools comprising a die with an aperture that is opposite a punch assembly comprising a punch surrounded by a stripper mechanism. Layers of ductile material are sandwiched between the punch assembly and when the punch is pressed towards the aperture, material is drawn into the aperture. The material undergoes plastic deformation in the aperture to flow into a shape in which two or more layers are interlocked, for example by the forming of one layer around another layer.

The aperture has a base with an anvil having an anvil surface and at least two side walls formed from movable blades. The blades are generally transverse to the anvil surface and extend in the direction in which the die and punch are pressed together. The blades help define the local area, for example a circular, square or rectangular area, in which the deformation of the layers of sheet material takes place. Once the material has been drawn and flows into the aperture, the blades move away from each other in a radial direction as sheet material flows laterally.

The outward movement of the blades is constrained by a die shield, which may be separate from but held in a fixed relationship with the die. In order to provide a compact die, the die shield can be joined to or integral with the die.

A circular die and punch can be used to form a clinch joint in which sheet material is symmetrically deformed both axially and radially to form a leak-proof button, for example as disclosed in patent document U.S. Pat. No. 5,150,513. A rectangular die and punch can be used to form a trapezoidal clinch joint (also called a lance joint), in which the sheet material is cut through by the punch along a pair of parallel opposed lines, with the layers of sheet material deformed laterally outwards underneath each of the cuts.

One commercially available example of a joining tool for forming a circular clinch joint is the SR 504 Series die and punch tool set from Bollhoff Fastenings Limited of Willenhall, West Midlands, UK. This tool set has a nominal 5 mm aperture with four movable die blades constrained by a separate die shield having an inner diameter of 16 mm.

A more compact die and punch would be desirable, for example allowing the sheet material joining tool to get further into corners or other awkward locations when fabricating a structure from the sheet material. However, there is a trade off between the strength of the tool and the maximum thickness of sheet material that may be joined, and the overall size, particularly in the direction transverse to the direction in which pressure is applied.

The die shield is arranged so that much of the pressure between the die and punch assembly is born by the die shield and stripper mechanism. However, the die blades experience increasing pressure as material is pressed into the aperture. This pressure can result in restriction of the movement of the die blades, resulting in a bad joint and/or damage to the die blades, particularly if the die blades are made thinner to reduce the lateral extent of the die.

A further constraint results from the necessity to include in the die some means of biasing the die blade back towards the anvil surface after the drawing operation by the punch is completed. For this, a coil spring or o-ring can be provided extending around the outside of the die blades. As the die blades move outwards to dilate the aperture, the spring or o-ring becomes stretched or compressed. When the joined sheet material is withdrawn from the aperture, the die blades return to their start position owing to the tension or compression in the spring or o-ring.

Because the spring or o-ring extends around the outside of the die blades usually between the die blades and the surrounding die shield, lateral space must be provided for the spring or o-ring. This again limits further reduction in the lateral extent of the die. Furthermore, lateral clearance space can result in a die blade being dislodged from between the anvil and die shield, and being lost from the die. This is very inconvenient in a production environment, as any machine using the sheet metal joiner would then have to be stopped to repair or replace the faulty die. If the faulty die were not spotted immediately, a great deal of rework to joined fabrications might then be required.

In some dies, the die blades slide laterally outwards, in which case the aperture depth is unchanged as the die blades move. However, the pressure imparted on the die blades can inhibit such a sliding motion, unless a die shield is used. Such a die shield will increase the lateral extent of the die.

Sometimes the die blades pivot outwards about a pivot mechanism below the level of the anvil surface. The pivot mechanism has a pivot axis or pivot point below and laterally outside an edge of the anvil surface. Because of this and the requirement that die blades should have a wide base or pivot with sufficient surface area to withstand the pressures during drawing, the die blades tend to rise when pivoted outwards. This tends to increase the pressure on the die blades, and again limits the amount by which the lateral dimensions of the die can be reduced.

SUMMARY OF THE INVENTION

The present invention addresses the problems cited above, and provides a die for a ductile material joiner, and also a ductile material joiner for clinch joining two or more layers of ductile material, which addresses these issues.

Accordingly, the invention provides a die for a ductile material clinch joiner, comprising:

a) a die anvil, the anvil having a body portion and an anvil surface;

b) at least two die blades, the blades extending generally transverse above and below the anvil surface and forming with the anvil surface a die aperture for a die punch, the separation between the blades defining a die aperture width or diameter and the extension of the die blades above the anvil surface defining a die aperture depth;

c) at least one pivot recess in the body portion;

d) a protrusion on each of the die blades, each protrusion being seated in a matching pivot recess to form with the recess a pivot joint by which each die blade may pivot with respect to the anvil body portion in order to constrict and dilate the aperture width or diameter;

e) at least one biasing member by which the die blades are biased to constrict the die aperture; and f) a die shield around the die blades;

wherein the pivot joints extend underneath the anvil surface so that when the die aperture is dilated the aperture depth is decreased.

Also according to the invention, there is provided a ductile material joiner for clinch joining two or more layers of ductile material, comprising a punch tip and a die according to the invention, the die having an aperture matching the punch tip.

In a round clinch joint, the punch tip should match the die aperture with clearance that is sufficient so that ductile material is drawn down between the punch tip and die blades prior to compression of the material against the anvil surface and consequent lateral flow of the ductile material.

In a lance joint, the punch tip should match the die aperture with a close clearance so that ductile material is cut along the die blades prior to compression of the material against the anvil surface and consequent lateral flow of the ductile material under the cut.

The provision of the pivot joint underneath the anvil surface can be used to reduce the lateral extent of the die blade. This is because the joint then extends laterally further inwards, for example towards a central longitudinal axis of symmetry of the die.

At the same time, this arrangement permits the depth of the aperture to be decreased when the aperture is dilated, and this helps to permit a reduction in pressures borne by the die blades as the die blades move outwards during the joining of the sheet material. This facilitates movement of the die blades and hence formation of the joint. For example, the pivot joint will have a pivot point or pivot axis, and provision of at least a part of the pivot joint underneath the anvil surface permitting this axis to be moved inwards. Bringing the pivot axis laterally inwards allows the die blade to pivot so that as the aperture dilates, the depth of the aperture decreases.

It is not necessary however, for the aperture depth to decrease as the die blades first start to pivot laterally outwards. For example, the pivot point or pivot axis may be laterally between a pair of longitudinal axes defined by the limits of travel of tips of the dies blades extending above a substantially flat anvil surface, the pair of longitudinal axes being transverse to the anvil surface. Then, the height of the die blade tips above a plane defined by the anvil surface will fall as the die blade become fully dilated. If the pivot point or pivot axis is approximately central between the pair of longitudinal axes, then this height will initially rise as the die blades begin to move laterally outwards, then fall as the die blades move fully outwards. Preferably, the pivot point or axis will be closer to the innermost of the pair of longitudinal axes, so that height of the tip of the die blade above the plane defined by the anvil surface is lower when the aperture is fully dilated than when the aperture is constricted. In any event, depth of the aperture may increase as the aperture is partially dilated, and then decrease as the aperture is fully dilated.

The pressure on the die blade is then partially relieved during the time when a maximum pressure would be expected to be exerted on the die blades, i.e. as the sheet material joint forming process completes formation of the joint.

The recess underneath the anvil surface may be a part spherical or a part cylindrical pivot socket, in which case the die blade protrusion may be a convex surface matching the pivot socket so that the convex surface rotates in the pivot socket when the die blade is pivoted. The surfaces may be essentially spherical, with clearance provided for manufacturing tolerances. Additional clearance may be required if the pivot joint is not cylindrical. For example, the pivot joint can be part-toroidal with the blade protrusion having a similar part-toroidal shape. Additional clearance must then be provided between the protrusion and the recess to allow for the fact that as the protrusion pivots in the recess, the central part and end parts along the arc of the protrusion will move relatively apart in a longitudinal direction.

Preferably, the anvil has a shoulder that extends in a plane below the anvil surface and that supports a die blade endmost portion. The die blade endmost portion may be a portion of the die blade protrusion. In a preferred embodiment of the invention, the shoulder extends tangentially from the pivot recess.

It is advantageous if the biasing member is provided between the die blade and the shoulder. The biasing member then does not add to the lateral extent of the laterally biased die blades. The biasing member is preferably a resilient ring, for example a nitrile o-ring, that is compressed between the die blade and the shoulder when the die blade is pivoted to dilate the aperture.

There may however, be alternatively or additionally a resilient biasing member, for example a coil spring or an o-ring, stretched around laterally outwards facing surfaces of the die blades below the level of the anvil surface. The effect of a biasing member provided between the die blade and the shoulder may permit a reduction in the size of a second biasing member stretched around laterally outwards facing surfaces of the die blades. This facilitates a reduction in the lateral extent of the die, whilst at the same time maintaining good inward biasing of the die blades.

In one embodiment of the invention, the anvil surface is bounded by a generally circular periphery, the die blades extending in an arc around at least part of said periphery.

In an alternative embodiment of the invention, the anvil surface is bounded by a generally square or rectangular periphery, the die blades extending along at least two opposed sides of said periphery.

It is advantageous if the die shield remains in close proximity with a portion of the die blade adjacent the protrusion at the die blade is pivoted to dilate and constrict the aperture. This helps to keep each die blade retained to the die.

In one embodiment, the die shield is integral with the body portion, and the die blades are removably inserted in an opening in a side of the body portion. In another embodiment of the invention, the die shield is removably attached to the body portion and the die shield prevents the die blades from being removed from the die when the die shield is attached to the body portion.

DETAILED DESCRIPTION

Figure 1:
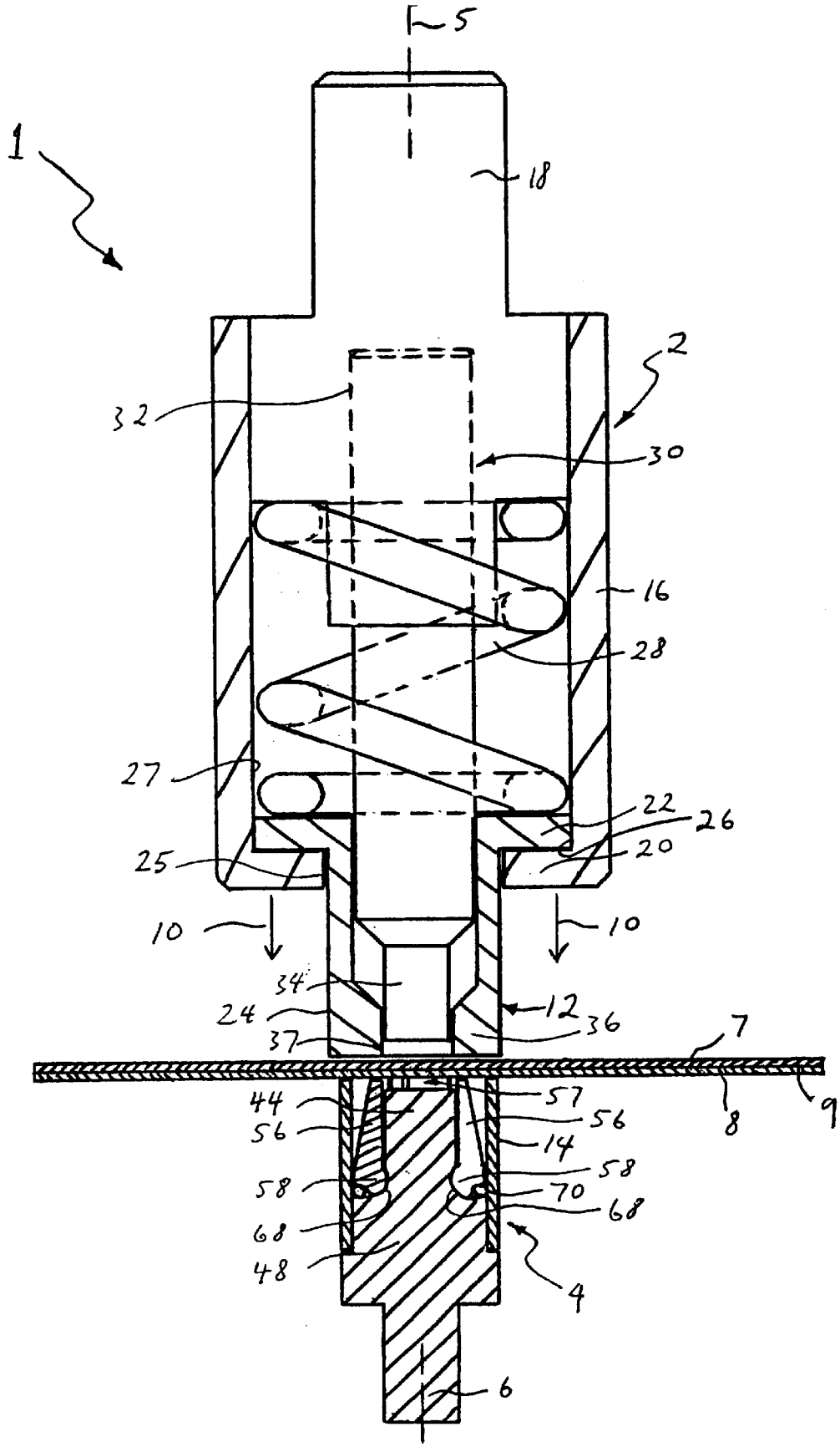
FIG. 1 is a view in partial cross section through a sheet material clinch joiner comprising a punch with a retracted punch tip on one side of a pair of metal sheets, and opposite this a die according to a first embodiment of the invention.

FIG. 1 shows a first embodiment of a sheet metal clinch joiner 1, comprising a punch assembly 2 and a die 4. The punch assembly 2 and die 4 are cylindrically symmetric and are aligned along common cylindrical axes 5,6. Between the punch assembly 2 and die 4 are a pair of thin metal sheets 7,8 which are aligned transverse to the punch assembly and die axes 5,6. The sheets 7,8 are in contact along a common interface 9. In a sheet material joining operation, the punch assembly 2 is brought towards the pair of sheets 7,8 as indicated by arrows 10 until a forward hollow stripper tip 12 of the punch assembly 2 comes into contact with one of the metal sheets 7, thereby pressing the other metal sheet 8 against a cylindrical die shield 14 of the die 4.

Figure 2:
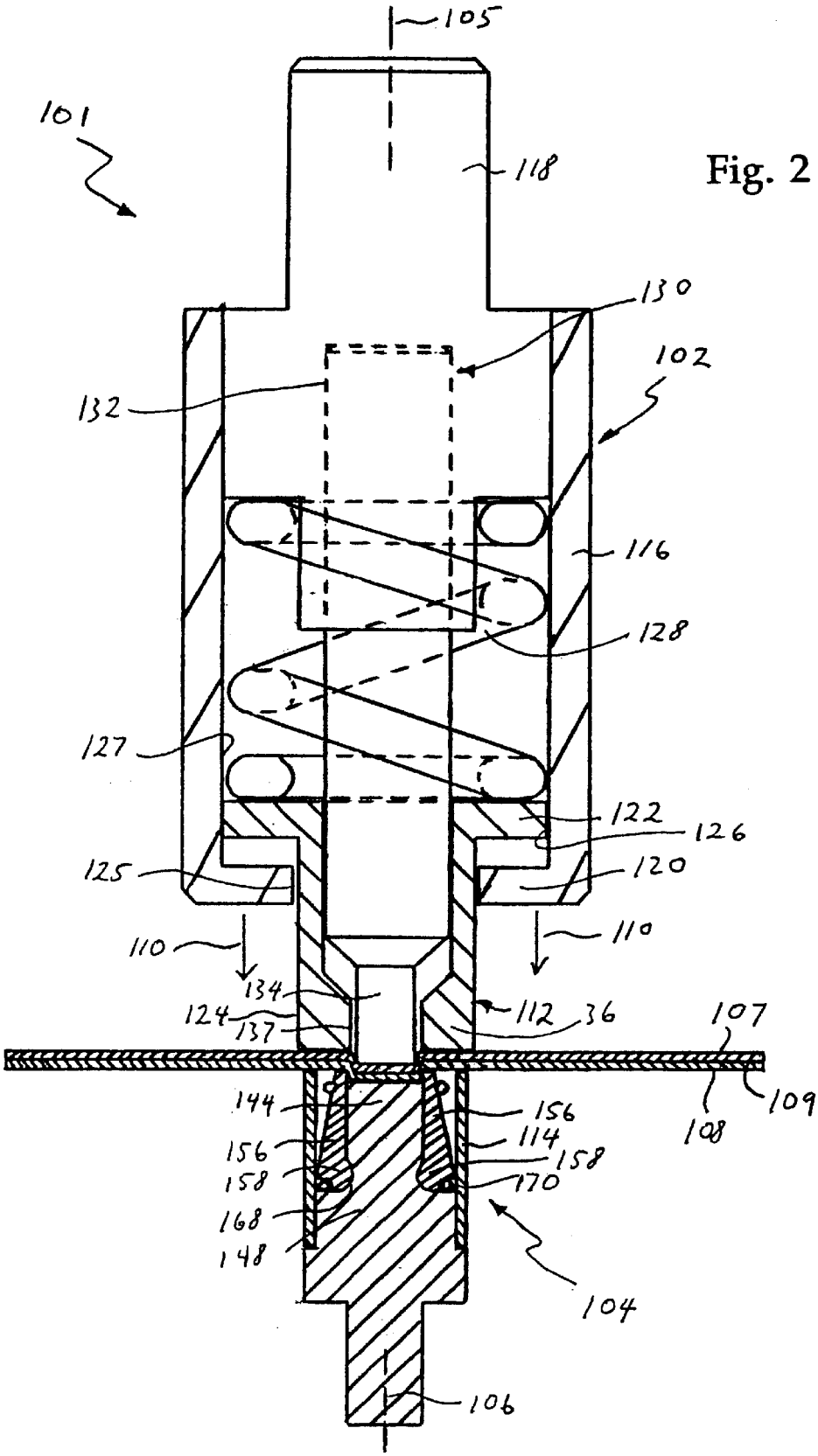
FIG. 2 is a view in partial cross section through a sheet material clinch joiner comprising a punch with an extended punch tip on one side of a pair of metal sheets, and opposite this a die according to a second embodiment of the invention, and showing the punch tip deforming the layers of sheet metal into an aperture of the die.

FIG. 2 shows a second embodiment of a sheet metal joiner 101 in which parts common with the first embodiment 1 are indicated by reference numerals incremented by 100. The operation of the first and second embodiments 1,101 is essentially the same. The punch assembly 2,102 has a main cylindrical housing 16,116 referred to herein as a stripper can. The end of the stripper can 16,116 away from the metal sheets 7,8; 107,108 has an open end plugged with a punch holder 18,118. The other end of the stripper can 16,116 has a radially inwards directed lip 20,120 which terminates in a central circular aperture from which the stripper tip 12,112 extends. The stripper tip 12,112 has an outwardly directed flange 22,122. An outer cylindrical surface 24,124 of the stripper tip 12 is a close sliding fit with a matching cylindrical surface 25,125 of the stripper can lip 20,120. In addition, the stripper tip flange 22,122 has an outer cylindrical surface 26,126 which has a close sliding fit with an inner cylindrical surface 27,127 of the stripper can 16,116. The stripper tip 12,112 is therefore free to slide axially with respect to the stripper can 16,116.

The sliding fit of the stripper tip 12,112 within the stripper can 16,116 is limited in an outwards direction by contact between the stripper can lip 20,120 and the stripper tip flange 22,122. A coil spring 28,128 is retained within the stripper can 16,116 between the punch holder 18,118 and the stripper tip flange 22,122. The coil spring 28,128 biases the stripper tip 12,112 outwards so that in a rest condition the stripper tip flange 22,122 remains in contact with the stripper can lip 20,120. The axial sliding movement of the stripper tip with respect to the stripper can is limited in an axially inwards direction by compression of the spring 28,128 against the punch holder 18,118.

A cylindrically symmetric punch 30,130 is axially centered on the punch axis 5,105, and is set into a cylindrical recess 32,132 in the punch holder 18,118. The punch 30,130 extends axially along the centre of the stripper can 16,116 into the stripper tip 12,112, where the punch 30,130 tapers down to a punch tip 34,134. The stripper tip 12,112 terminates in a neck 36,136 with a cylindrical inner surface 37,137 that is a close sliding fit with the cylindrical stripper tip 34,134.

When the punch assembly 2,102 is moved 10,110 up against the metal sheet 7,107 the stripper tip 12,112 comes first into contact with the metal sheet 7,107. Further movement 10,110 then causes the stripper tip 12,112 to slide axially with respect to the stripper can 16,116, with the result that the spring 28,128 begins to be compressed whilst the punch tip 34,134 continues with the motion 10,110 towards the metal sheet 7,107.

As this is happening, the die 4,104 provides a restoring force against the other metal sheet 8,108. Most of the restoring force is provided through the die shield 14,114.

The die shield 14,114 stands higher than the die blades 56,156 with sufficient clearance that the die blades may pivot outwards as the metal layers 7,8; 107; 108 are drawn down by the punch tip 34,134.

The first and second embodiments of the die 4,104 are shown in more detail in FIGS. 3–7. The die 4,104 has a unitary anvil body 40,140 which is cylindrically symmetric about die axis 6,106. The anvil body 40,140 has at one end a lower stem 42,142 that in use is seated in a tool holder (not shown). At the opposite end of the anvil body 40,140 is a die anvil 44,144 with an anvil surface 46,146. A die main body portion 48,148 with a diameter greater than that of the die stem 42,142 and die anvil 44,144 extends between the die stem and die anvil.

The die shield 14,114 extends around and is spaced from the die anvil 44,144 by a gap 50,150, and is securely attached to the die main body portion 48,148 by an interference fit with a rebate 52,152 in the die main body portion 48,148. The rebate 52,152 has a ledge 54,154 that faces in a direction axially towards the die anvil 44,144, so that when the die shield bears the pressure of the punch assembly 2,102, the die shield 14,114 is retained by the ledge 54,154.

The gap 50,150 between the die shield 14,114 and the die anvil 44,144 is substantially filled by a number of die blades 56,156. The first embodiment of the die 4 has seven die blades 56 equally spaced around the circular periphery of the anvil 44. The die blades 56 are each separated from adjacent die blades by a short gap 57.

Figures 3, 4, 5, 6, 7:
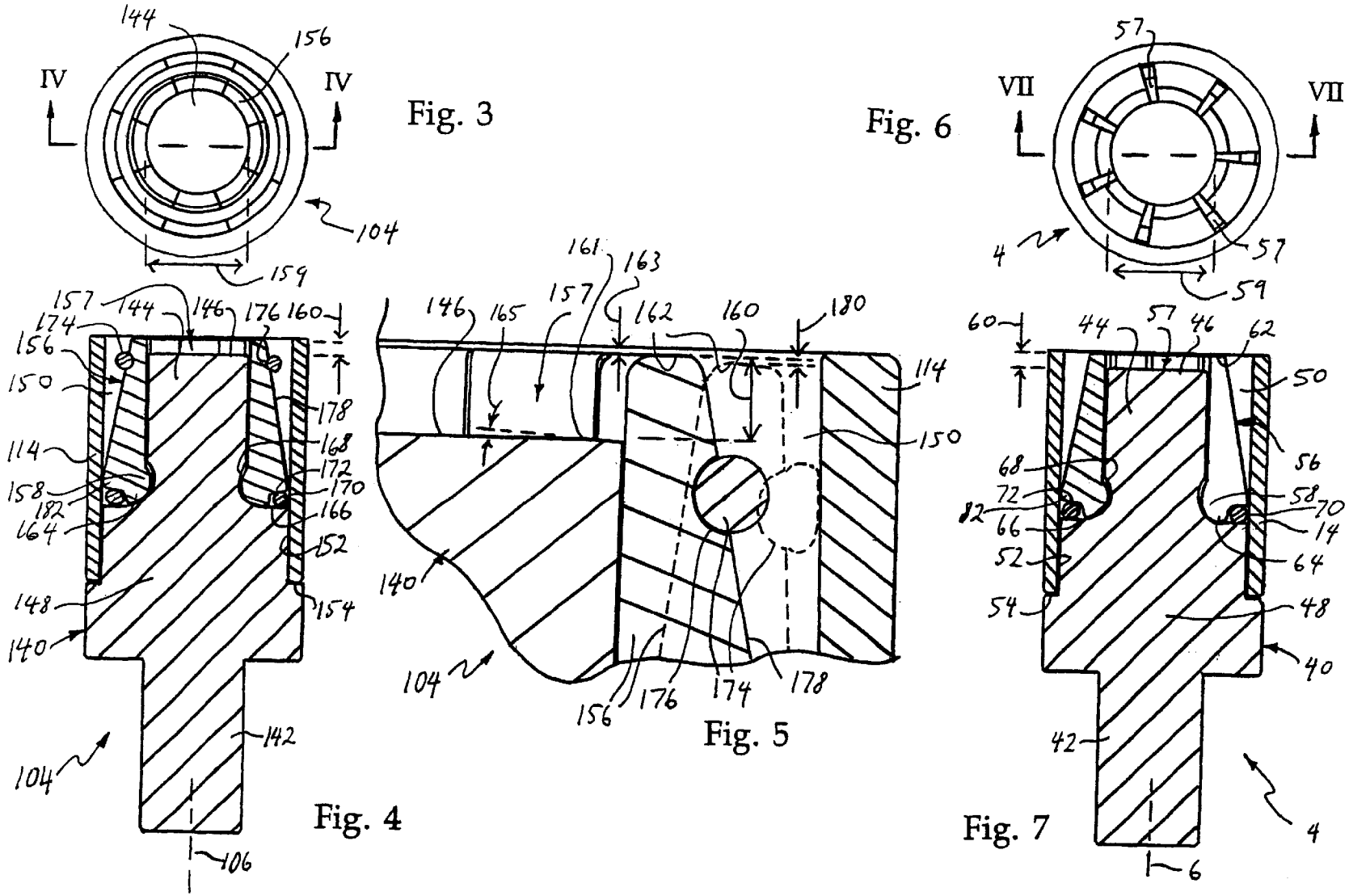
FIGS. 3, 4 and 5 are views of the die of FIG. 2 showing, respectively, a view facing into the die aperture and showing a cylindrical symmetry of the die, a cross-sectional view in a plane through a cylindrical axis of the die, and an enlarged view of a portion of the die showing a number of die blades moveable between a central die anvil and a peripheral die shield.
FIGS. 6 and 7 are, respectively, views of the die of FIG. 1, facing into the aperture and along a central cylindrical axis of the die.

The second embodiment of the die 104 has eight equally spaced die blades 156 around the circular periphery of the die anvil 144. As can be seen in FIG. 3, there are no gaps between the die blades 156 when the die blades are up against the die anvil 144.

The die anvil surface 146 is flat, except for a peripheral region 161 that is angled 165 down at about 3° in order to relieve pressure on the peripheral region when sheet material 108 is drawn down onto the anvil surface 146. This helps to avoid abrasion or chipping of the anvil surface peripheral region 161.

The die blades 56,156 extend generally transverse above and below the anvil surface 46,146 and form with the anvil surface an aperture 57,157 for the punch tip 34,134. The separation between the blades 56,156 defines the aperture width 59,159, and the extension of the die blades above the anvil surface 46,146 defines an aperture depth 60,160.

As can be seen best in FIG. 5, each die blade 56,156 has a tip 62,162 which is recessed a short distance 163 below the level of the die shield 14,114. The die shield 14,114 therefore bears most of the pressure imparted by the punch assembly 2,102.

Each die blade 56,156 has a base 64,164 at the opposite end from the die blade tip 62,162. The die blade base 64,164 is seated on a shoulder 66,166 between the die main body portion 48,148 and die anvil 44,144. The shoulder 66,166 extends in a plane transverse to the die axis 6,106 between the die shield 14,114 and a pivot recess 68,168 that extends directly underneath the die anvil surface 46,146. Each die blade 56,156 has a protrusion 58,158 that extends into the recess 68,168, so that the protrusion and recess form a pivot joint by which each die blade 56,156 may pivot at its tip 62,162 laterally towards and away from the die anvil surface 46,146 respectively to constrict and dilate the die aperture 57,157.

The recess 68,168 is essentially part-toroidal in shape, with the die blade protrusions 58,158 having a similar matching part-toroidal shape. There is provided normal manufacturing clearance between the protrusions and the recess, but also an additional clearance along an upper portion of the interface between the protrusions 58,158 and the recess 68,168, to allow for the fact that as the die blades pivot, the arcuate ends of each toroidal protrusion will tend to rise and fall slightly whilst the central part of the die blade base 64,164 remains in contact with the shoulder 66,166.

The first embodiment of the die 4 is provided with one resilient nitrile o-ring 70 that extends around the periphery of the shoulder 66,166 in a matching channel formed by a rebate 72 in a lower outer corner of each die blade lower portion 64. As each die blade 56 pivots outwards, the rebate 72 compresses the o-ring against the shoulder 66. This biases each die blade 56 back towards the die anvil 44.

The second embodiment of the die 104 has a similar o-ring 170 and rebate 172, and also a second o-ring 174 which is stretched around and seated in a groove 176 in a laterally outward facing surface 178 of each die blade 156. The second o-ring 174 is preferably provided proximate the die blade tip 162 in order to provide for a maximum of lateral outwards movement for each die blade 156 in the gap 150 between each die blade 156 and the die shield 114.

FIG. 5 shows in phantom outline how the die blade 156 compresses the second o-ring 174 as each die blade 156 is moved towards the surrounding die shield 114. This compression and also the stretching of the second o-ring owing to the increased circumference around the die blades 156, provides an additional biasing force to return each die blade 156 towards the die anvil 146.

It should be noted that the pivot formed by each die blade protrusion 58,158 in the recess 68,168 is a slightly greater radius from the die axis 6,106 than the outer radius of the die anvil surface 46,146 and also the inner radius of the die blade tip 62,162. Therefore, as each die blade 56,156 pivots laterally outwards, each die tip 62,162 rises slightly, but not so far that each die tip 62,162 rises above the level of the surrounding die shield 114.

In the first embodiment of the die 4, the outwards pivoting of each die blade 56 is limited by the contact of each die blade 56 and the surrounding die shield 14.

In the second embodiment of the die 104 the outwards pivoting of each die blade 156 is limited by the contact of the second o-ring 174 and the surrounding die shield 114. As shown in FIG. 5, at this point the tip 162 of each die blade 156 has dropped by a distance 180 further below the rim of the surrounding die shield 114 and the distance 163 of the die blades when up against the die anvil 144. This is possible because at the outermost pivot of each die blade 156, the die blade tip 162 is radially outwards of the effective pivot point or pivot axis of the die blade protrusion 158 in the recess 168. The maximum outwards deflection for the die blades 56 of the first embodiment of the die 4 is up against the surrounding die shield 14. Because each die blade 56 in the first embodiment of the die 4 can pivot radially further outwards than each die blade 156 of the second embodiment 104, the die blade tips 62 of the first embodiment 4 drop further below the level of the surrounding die shield 14 than indicated in FIG. 5.

The first embodiment of the die 4 therefore provides a greater reduction in compressive force on the die blade tips 62 whilst the second embodiment of the die 104 provides an increased radially inwards biasing force to return each die blade 156 to the die anvil 144. In both embodiments, the radial extent of the die 4,104 is minimized by the provision of the recess 68,168 under the die anvil 46,146, and also by minimising the gap 50,150 between the die shield 14,114 and each die blade 56,156.

An important benefit of minimising the gap 50,150 is that the die shield 14,114 can be arranged to be in contact with a heel 82,182 of the die blade near the o-ring rebate 72,172. The die 4,104 is assembled by first placing each die blade 56,156, and o-ring 70,170,174 in place around the die anvil 44,144. The die shield 14,114 is then inserted over the die blades and die body rebate 52,152. Each die blade 56,156 is then securely held by the die shield 14,114 which keeps each die blade protrusion 58,158 securely engaged in its recess 68,168.

Figure 10:
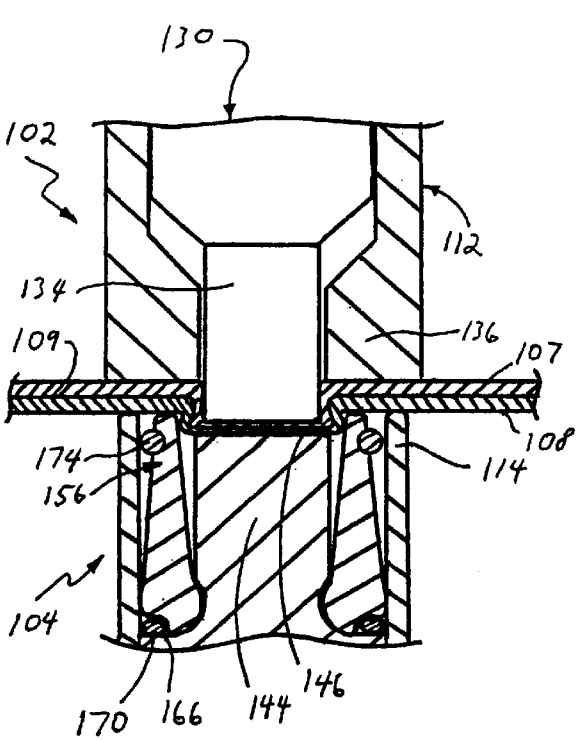
FIGS. 8, 9 and 10 are views showing how the punch tip and second embodiment the die co-operate to form a clinch joint in the two sheets of metal as the punch tip is driven towards the anvil surface.
Figure 9:
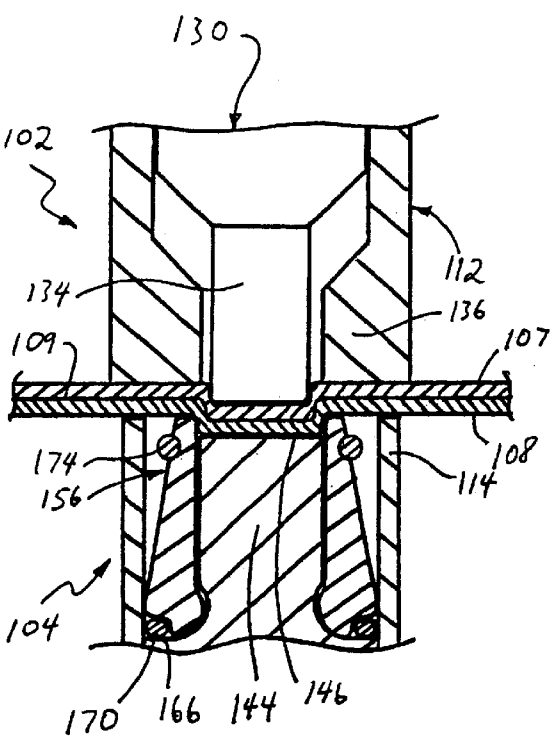
Figure 8:
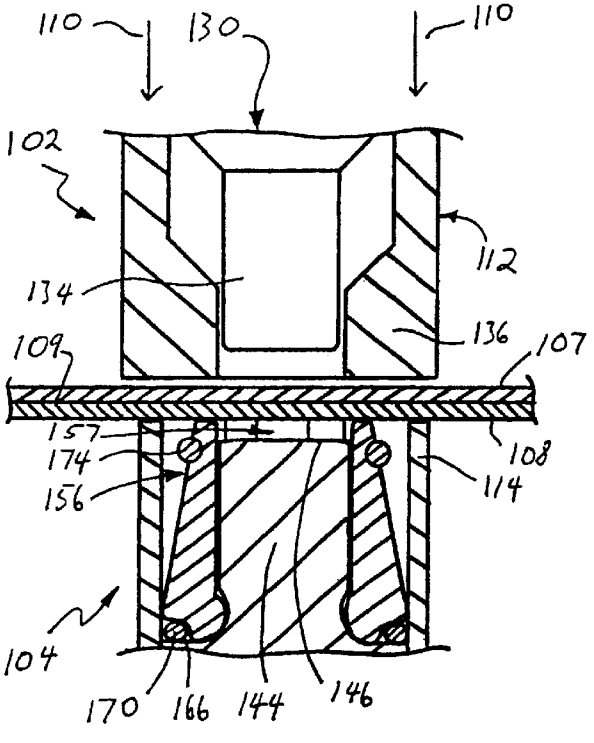

Reference is now made to FIGS. 8, 9 and 10 which show for the second embodiment of the invention the operation of the die punch tool 102 and die 104. In FIG. 8 the punch assembly 102 is being moved 110 towards the metal sheets 107,108. When the stripper tip 112 comes into contact with the upper metal sheet 107, the punch 130 continues to move towards the upper metal sheet until the punch tip 134 comes into contact with the upper metal sheet 107 and begins to deform plastically both metal sheets 107,108 into the die aperture 157. When the two sheets of metal 107,108 have filled the die aperture 157 as shown in FIG. 9, further movement of the punch tip 134 into the die aperture 157 causes lateral plastic deformation of the metal sheets 107, 108 as shown in FIG. 10. The lateral movement of the metal sheets 107,108 causes each die blade 156 to pivot outwards thereby compressing the o-ring 170 between each die blade 156 and the die shoulder 166, and also stretching and extending the second o-ring 174 that extends around all of the die blades 156.

In the plastic deformation process, the metal sheets 107, 108 are deformed into a button shape with the interface 109 doubling back on itself in an s-shape at the edges of the button shape. This locks the two sheets of metal 107,108 together at this localized area.

When the drawing pressure is relieved, the die tip 134 is withdrawn under the action of the coil spring 128 that was compressed in the drawing process. The punch tip 112 is then removed from the upper metal sheet 107, and at the same time the die 104 is removed from the lower metal sheet 108, whereupon each die blade 156 springs back against the die anvil 144 under the biasing action of the o-rings 170,174.

Figure 12:
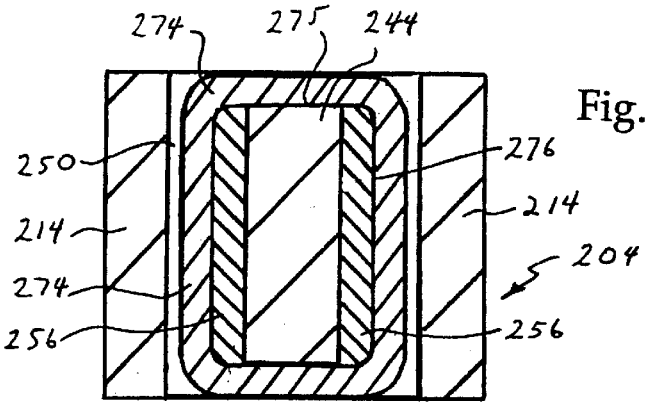
FIG. 12 is a cross-section through the die of FIG. 11, taken along lines XII—XII.
Figure 11:
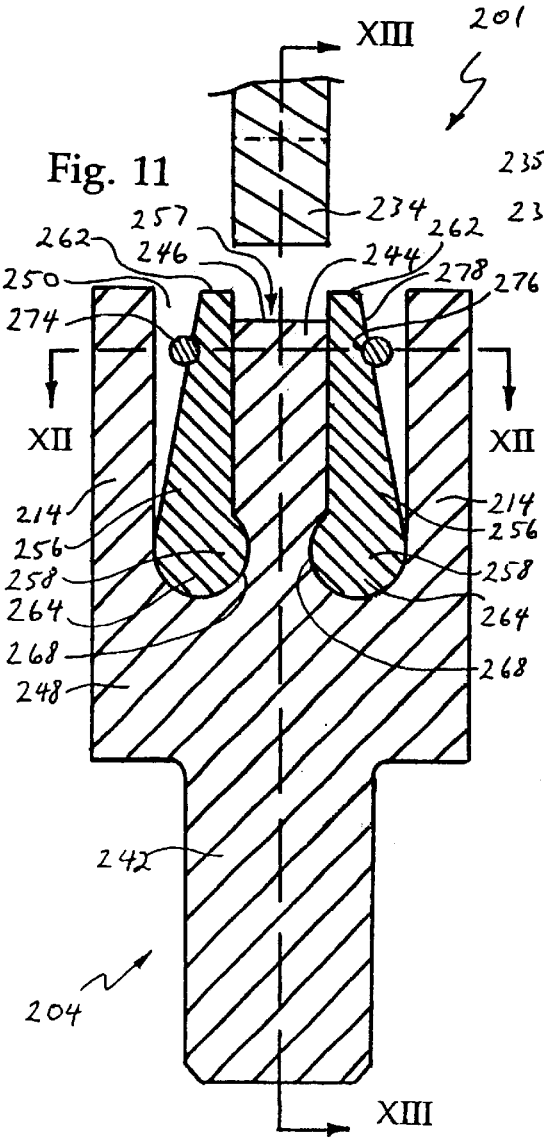
FIG. 11 shows a cross-sectional view through a punch tip and a die according to a third embodiment of the invention, the die having a pair of parallel die blades either side of a central rectangular die anvil and a pair of parallel and integrally formed die shields laterally outwards of the die blades.
Figure 13:
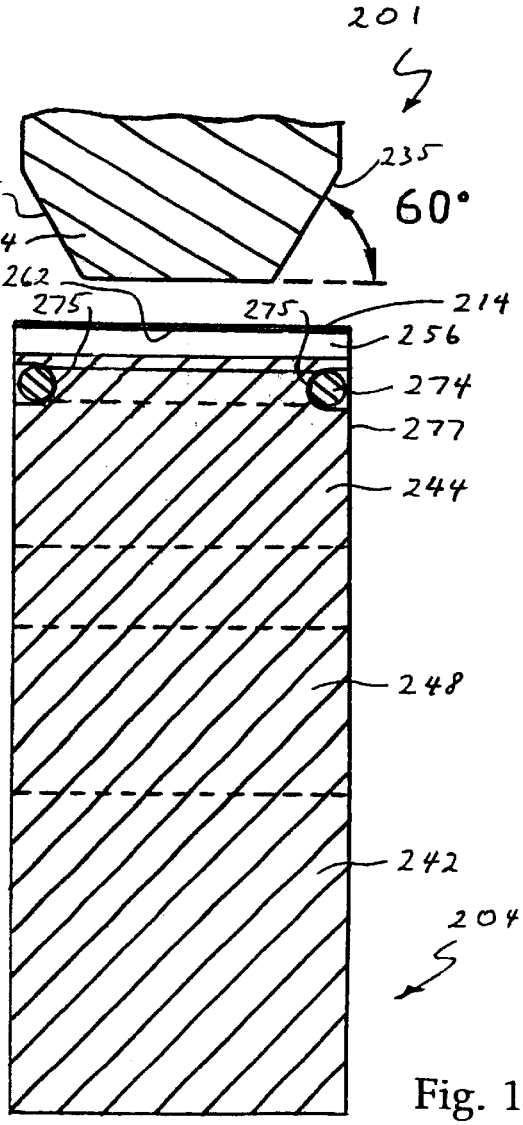
FIG. 13 is a cross-section through the die of FIG. 11, taken along lines XIII—XIII.

FIGS. 11, 12 and 13 show a third embodiment of a sheet metal clinch joiner 201. For convenience, components of the joiner 201 similar in function to those of a second embodiment 104 are represented by reference numerals incremented by 100.

The joiner 201 has a rectangular symmetry with a pair of straight parallel die blades 256 arranged either side of a rectangular die anvil 244. The die blades 256 are assembled by slotting each die blade 256 into a gap 250 between the die anvil 244 and a pair of straight parallel die shields 214. Because the die blades 256 are straight and can be slotted in from one side of the die 204, the die shields 214 are integral with a main die body portion 248 which is also integral with a die stem 242.

The die 244 could be provided with an o-ring which is compressed between a base portion 264 of each die blade 256 and a suitable internal shoulder. In this example however, just one o-ring 274 is wrapped around the die blades 256 seated in a channel 276 in a laterally outward facing surface 278 of each die blade 256. The o-ring 274 is also seated in a pair of channels 275 in open ends 277 of the die anvil 244. The operation of the joiner 201 is similar to that for the first and second embodiments 1,101 and so will not be described in detail. The type of joint formed by the die tool 201 is a lance type joint in which sheet material is cut along two parallel lines formed by the scissor-like contact between the die tip 234 and each die blade 256. The die tip 234 has between the die blades 256 two tapered ends 235 which form a ramp in the sheet materials which are deformed into a die aperture 257. Compression of sheet materials into the die aperture 257 results in lateral flow of the sheet materials mainly in two opposite lateral directions towards each die blade 256. This flow causes the sheet materials to flow underneath the cuts initially formed in the materials.

Because each die blade 256 has a protrusion 258 extending into a recess 268 underneath an anvil surface 246, each die blade 256 is able to pivot in a similar manner to the first and second embodiments 1,101, so that each die blade tip 262 drops as the aperture 257 is fully dilated. Because of the cylindrical symmetry of the pivot joint formed by the die blade protrusion 258 in the anvil recess 268, there is no need as in the first and second embodiments for additional clearance between the die blade protrusion 258 and anvil recess 268 beyond normal manufacturing tolerances.

The clinch joining tools described above have a compact lateral dimension relative to the size of the joint made in sheet materials. For example, in the first and second embodiments 1,101, the diameter of the constricted die aperture may be between 2 to 12 mm, in which case the outer diameter of the die shield 14,114 will be between, respectively, 7 to 18 mm. The depth of the aperture will depend on the separation between the die blades and thickness of sheet material to be joined, but typically will be between 0.5 to 2 mm. The die blade tips 62,262 will when the aperture is constricted be about 0.05 mm below the level of the surrounding die shield 14,114. When the die aperture 57,157 is fully dilated, then each die blade tip will be between about 0.10 and 0.15 mm beneath the level of the surrounding die shield 14,114.

It is to be recognized that various alterations, modifications, and/or additions may be introduced into the constructions and arrangements of parts described above without departing from the spirit or ambit of the present invention.

What is claimed is:

1. A die for a ductile material clinch joiner, comprising:

a) a die anvil, the anvil having a body portion and an anvil surface;

b) at least two die blades, the blades extending generally transverse above and below the anvil surface and forming with the anvil surface a die aperture for a die punch, the separation between the blades defining a die aperture width or diameter and the extension of the die blades above the anvil surface defining a die aperture depth;

c) at least one pivot recess in the body portion of the anvil;

d) a protrusion on each of the die blades, each protrusion being seated in a matching relationship with the pivot recess to form a pivot joint by which each die blade may pivot with respect to the body portion of the anvil in order to constrict and dilate the aperture width or diameter, the pivot joint having a pivot axis;

e) at least one biasing member by which the die blades are biased to constrict the die aperture; and f) a die shield around the die blades;

wherein the pivot joints extends directly underneath the anvil surface permitting the pivot axis to move inwards so that when the die aperture is dilated the aperture depth is decreased.

2. A die as claimed in claim 1, in which the recess is a part spherical or a part cylindrical pivot socket, and the die blade protrusion has a convex surface matching the pivot socket so that the convex surface rotates in the pivot socket when the die blade is pivoted.

3. A die as claimed in claim 2, in which the convex surface is part-parabolic.

4. A die as claimed claim 1, in which the anvil has a shoulder that extends in a plane below the anvil surface and that supports a die blade endmost portion.

5. A die as claimed in claim 4, in which the die blade endmost portion is a portion of the die blade protrusion.

6. A die as claimed in claim 4, in which the shoulder extends tangentially from the pivot recess.

7. A die as claimed in claim 4, in which the biasing member is provided between the die blade and the shoulder.

8. A die as claimed in claim 7, in which the biasing member is a resilient ring that is compressed between the die blade and the shoulder when the die blade is pivoted to dilate the die aperture.

9. A die as claimed in claim 1, in which the anvil surface is bounded by a generally circular periphery, the die blades extending in an arc around at least part of said periphery.

10. A die as claimed in claim 1, in which the anvil surface is bounded by a generally square or rectangular periphery, the die blades extending along at least two opposed sides of said periphery.

11. A die as claimed in claim 1, in which the die shield remains in close proximity with a portion of the die blade adjacent the protrusion as the die blade is pivoted to dilate and constrict the die aperture.

12. A die as claimed in claim 11, in which the die shield is removably attached to the body portion, the die shield preventing the die blades from being removed from the die when the die shield is attached to the body portion.

13. A die as claimed in claim 1, in which the die shield limits the extent by which the die blades may pivot to dilate the aperture.

14. A ductile material for clinch joining two or more layers of ductile material, comprising a punch tip and a die with a die aperture matching the punch tip, wherein the die comprises:

a) a die anvil, the anvil having a body portion and an anvil surface;

b) at least two die blades, the blades extending generally transverse above and below the anvil surface and forming with the anvil surface a die aperture for a die punch, the separation between the blades defining a die aperture width or diameter and the extension of the die blades above the anvil surface defining a die aperture depth;

c) at least one pivot recess in the body portion;

d) a protrusion on each of the die blades, each protrusion being seated in a matching relationship with the pivot recess to form a pivot joint by which each die blade may pivot with respect to the anvil body portion in order to constrict and dilate the aperture width;

e) at least one biasing member by which the die blades are biased to constrict the die aperture; and f) a die shield around the die blade;

wherein the pivot joint extends directly underneath the anvil surface permitting the pivot axis to move inwards so that when the die aperture is dilated the aperture depth is decreased.

15. A ductile material joiner as claimed in claim 14, in which the depth of the die aperture increases as the die aperture is partially dilated, and then decreases as the die aperture is fully dilated.

* * * * *